US012644657B2

(12) United States Patent
Xiao et al.

(10) Patent No.: US 12,644,657 B2
(45) Date of Patent: Jun. 2, 2026

(54) LIQUID COOLING HEAT DISSIPATION DEVICE

(71) Applicant: APALTEK CO., LTD., Shenzhen (CN)

(72) Inventors: Qineng Xiao, Dongguan (CN); Dagao Zheng, Shenzhen (CN)

(73) Assignee: APALTEK CO., LTD., Shenzhen (CN)

( * ) Notice: Subject to any disclaimer, the term of this patent is extended or adjusted under 35 U.S.C. 154(b) by 141 days.

(21) Appl. No.: 18/894,343

(22) Filed: Sep. 24, 2024

(65) Prior Publication Data

US 2026/0043622 A1 Feb. 12, 2026

(30) Foreign Application Priority Data

Aug. 12, 2024 (CN) ..... 202411098444.3

(51) Int. Cl.
*F28F 3/12* (2006.01)
*F28F 3/02* (2006.01)

(52) U.S. Cl.
CPC ..... *F28F 3/12* (2013.01); *F28F 3/02* (2013.01); *F28F 2215/00* (2013.01); *F28F 2220/00* (2013.01)

(58) Field of Classification Search
CPC .. F28F 3/12; F28F 3/02; F28F 2215/00; F28F 2220/00; H05K 7/20254; H05K 7/20272; H05K 7/20927; H10W 40/47
USPC ..... 165/104.19
See application file for complete search history.

(56) References Cited

U.S. PATENT DOCUMENTS 9,345,169 B1 * 5/2016 Campbell ..... H05K 7/20218
9,795,058 B2 * 10/2017 Tsai ..... H05K 7/20272
10,299,406 B2 * 5/2019 Lin ..... H05K 7/20336
10,509,446 B2 * 12/2019 Tsai ..... G06F 1/20
10,932,391 B2 * 2/2021 Tsai ..... H05K 7/20272
11,297,735 B2 * 4/2022 Lai ..... H05K 7/20272
11,627,686 B2 * 4/2023 Tsai ..... H05K 7/20254 361/699
11,800,679 B2 * 10/2023 Xiao ..... H05K 7/20272
11,815,104 B2 * 11/2023 Fan ..... F04D 29/026
(Continued)

FOREIGN PATENT DOCUMENTS

TW 202017458 A 5/2020

OTHER PUBLICATIONS

Office Action dated Mar. 14, 2025 of the corresponding Taiwan patent application No. 113130746.

*Primary Examiner* — Jon T. Schermerhorn, Jr.
(74) *Attorney, Agent, or Firm* — HDLS IPR SERVICES; Chun-Ming Shih

(57) ABSTRACT

A liquid cooling heat dissipation device for a coolant flowing in one direction has a bottom seat, a baffle, and a cover. The bottom seat has a plurality of heat dissipation members. A plurality of flow channels is formed between the heat dissipation members. The baffle is arranged on the bottom seat and defines a plurality of slot groups arranged in parallel. The slot groups are communicated to the flow channels. The cover is arranged on the baffle and defines a cavity and a through hole. The cavity is concave from a side of the cover facing the baffle and communicated to the slot groups to form a chamber. Two opposite sides of the chamber are respectively communicated to the through hole and the slot groups. The coolant enters the chamber for confluence from the flow channels through the slot groups, and then exits the chamber through the through hole.

9 Claims, 6 Drawing Sheets

(56) References Cited

U.S. PATENT DOCUMENTS

| | | | | |
|---|---|---|---|---|
| 11,953,274 | B2 * | 4/2024 | Tivadar | F28F 3/12 |
| 12,099,385 | B2 * | 9/2024 | Tsai | G06F 1/20 |
| 12,158,786 | B2 * | 12/2024 | Tsai | G06F 1/20 |
| 12,460,878 | B2 * | 11/2025 | Lyon | F28F 3/12 |
| 2008/0104992 | A1 * | 5/2008 | Lai | H10W 40/47 62/436 |
| 2009/0159244 | A1 * | 6/2009 | Mounioloux | F04D 29/586 165/104.33 |
| 2016/0338223 | A1 * | 11/2016 | Tsai | F28F 1/00 |
| 2017/0235350 | A1 * | 8/2017 | Tsai | G06F 1/20 165/80.4 |
| 2018/0139865 | A1 * | 5/2018 | Draht | H05K 7/20254 |
| 2018/0213677 | A1 * | 7/2018 | Wu | H10W 40/47 |

* cited by examiner

LIQUID COOLING HEAT DISSIPATION DEVICE

BACKGROUND

Technical Field

The present disclosure relates to heat dissipation field, particularly to a liquid cooling heat dissipation device.

Description of Related Art

With the increased demand of heat dissipation in recent years, liquid cooling has gradually replaced traditional air cooling. The liquid cooling heat dissipation device is one of the most widely used components in liquid cooling. The liquid cooling heat dissipation device mainly absorbs heat through a bottom seat attached to the heat source of the electronic component, and conducts the heat to a plurality of cooling fins on the bottom seat such that the coolant flowing through the cooling fins carries away the heat to achieve the cooling effect of the heat source of the electronic component.

However, the ordinary liquid cooling heat dissipation device generally arranges a baffle on the cooling fins, and an elongated hole is arranged on the baffle for the coolant to pass through. This results in a significant increase in the pressure and reduction in the flow rate of the coolant when it enters the elongated hole of the baffle from the gaps between the cooling fins. Therefore, the heat accumulates and cannot be effectively dissipated such that the heat dissipation efficiency of the liquid cooling heat dissipation device and the integral liquid cooling system are affected. Thus, how to design a liquid cooling heat dissipation device that may allow the coolant to flow stably without causing heat accumulation due to excessive pressure is an urgently desired improvement.

In view of the above, the inventor seeks to overcome the aforementioned drawbacks associated with the current technology and aims to provide an effective solution through extensive researches along with utilization of academic principles and knowledge.

SUMMARY

The primary objective of the present disclosure is to converge the coolant through the chamber formed by the cavity of the cover covering each of the slot groups, so as to effectively increase the flow rate of the coolant through the through hole to improve the heat dissipation efficiency of the liquid cooling heat dissipation device.

To accomplish the aforementioned objective, the present disclosure provides a liquid cooling heat dissipation device having a bottom seat, a baffle, and a cover. The bottom seat has a plurality of heat dissipation members. A plurality of flow channels is formed between the heat dissipation members. The baffle is arranged on the bottom seat. The baffle defines a plurality of slot groups arranged in parallel. Each of the slot groups is communicated to the plurality of flow channels. The cover is arranged on the baffle and covers each of the slot groups. The cover defines a cavity and a through hole. The cavity is concave from a side of the cover facing the baffle and communicated to each of the slot groups to form a chamber. Two opposite sides of the chamber are respectively communicated to the through hole and each of the slot groups. The coolant enters the chamber for confluence from each of the flow channels through each of the slot groups, and then exits the chamber through the through hole.

Another aspect of the present disclosure provides that the plurality of heat dissipation members includes a plurality of fins arranged in parallel along a first direction, each of the flow channels is formed between two adjacent fins.

Another aspect of the present disclosure provides that each of the slot groups is arranged in parallel along a second direction, the first direction intersects with the second direction.

Another aspect of the present disclosure provides that each of the slot groups includes an elongated hole extended along a second direction, each of the elongated holes is arranged in parallel along the second direction and configured to cross each of the fins.

Another aspect of the present disclosure provides that the first direction is perpendicular to the second direction.

Another aspect of the present disclosure provides that further includes a pressed board, the pressed board is arranged between the baffle and the cover, the pressed board defines a slit group, each of the slot groups is communicated to the chamber through the slit group.

Another aspect of the present disclosure provides that the slit group includes a plurality of transition channels arranged in parallel, a number of each of the transition channels is equal to a number of each of the slot groups, each of the transition channels is corresponding to each of the slot groups.

Another aspect of the present disclosure provides that further includes a base seat, the base seat is arranged on the bottom seat and defines an inlet and an outlet, the base seat, the bottom seat, and the cover form an inlet chamber, the base seat and the cover form an outlet chamber, the inlet is communicated to each of the flow channels through the inlet chamber, the through hole is communicated to the outlet through the outlet chamber.

Another aspect of the present disclosure provides that the cover has a convex edge, the base seat abuts against the convex edge such that the cover makes the baffle to tightly abut against the bottom seat.

Another aspect of the present disclosure provides that further includes a pump, the pump is arranged in the outlet chamber, a suction force is generated when the pump operates, the coolant sequentially enters the inlet chamber, each of the flow channels, each of the slot groups, the chamber, the through hole, and the outlet chamber from the inlet by the suction force and exits the liquid cooling heat dissipation device through the outlet.

In the liquid cooling heat dissipation device of the present disclosure, through the cavity of the cover covering each of the slot groups, the coolant may be converged in the chamber formed by the cavity and the baffle, so as to effectively increase the flow rate of the coolant through the through hole to improve the heat dissipation efficiency of the liquid cooling heat dissipation device.

DETAILED DESCRIPTION

Figure 1:
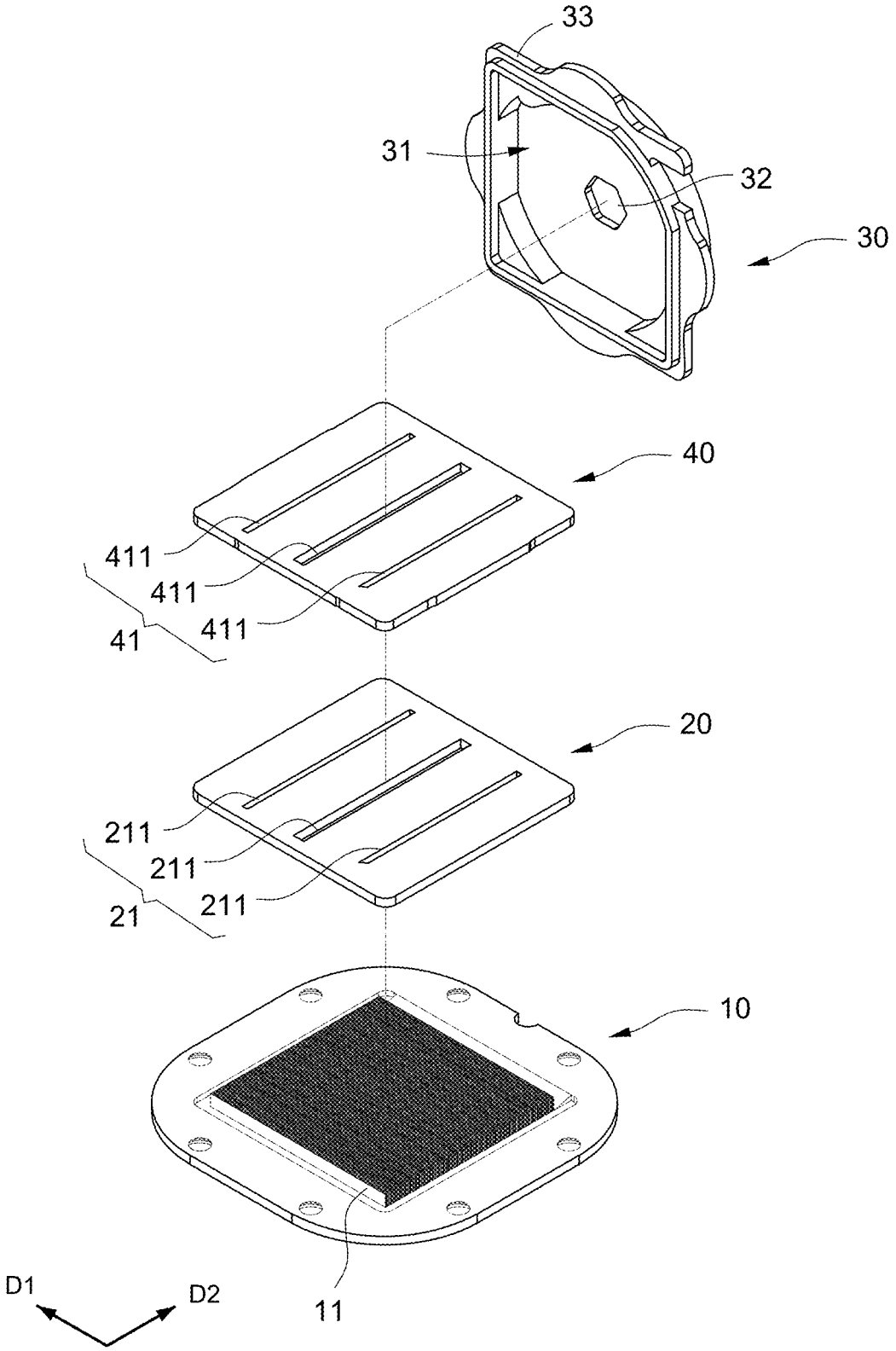
FIG. 1 is a partial exploded view of the present disclosure.

It is to be understood that the terms for indicating positions and the location relation, for example "front", "rear", "left", "right", "front end", "rear end", "distal end", "longitudinal direction", "lateral direction", "vertical direction", "top" and "bottom", are based on the positions and the location relation disclosed in the drawings, and only used for disclosing the present disclosure and not used for indicating or implying the specified location of the device or the components or the specified structure and operation in certain location, thus the present disclosure is not intended to be limiting.

For example, the terms of "first", "second", "third", "forth" and "fifth" are used for illustrating each unit, component, area, layer and/or part. The component, the unit, the area, the layer and/or the part are not limited by the terms. These terms are only used for separating the element, the assembly, the area, the layer, or the part. Unless being clearly indicated according to the whole specification, the terms for example "the first", "the second", "the third", "the fourth" and "the fifth" are not used for implying the order or sequence.

As used herein and not otherwise defined, the terms "substantially" and "approximately" are used to describe and describe small changes. When used in connection with an event or situation, the terms may include the precise moment at which the event or situation occurs, as well as the event or situation occurring to a close approximation. For example, when combined with a numerical value, the terms may include a range of variation equal to or less than ±5% of the numerical value, such as equal to or less than ±4%, equal to or less than ±3%, equal to or less than ±2%, equal to or less than ±1%, equal to or less than ±0.5%, equal to or less than ±0.1%, or equal to or less than ±0.05%.

The technical contents of the present disclosure will become apparent with the detailed description of embodiments and the accompanied drawings as follows. However, it shall be noted that the accompanied drawings are for illustrative purposes only such that they shall not be used to restrict the scope of the present disclosure.

Figure 2:
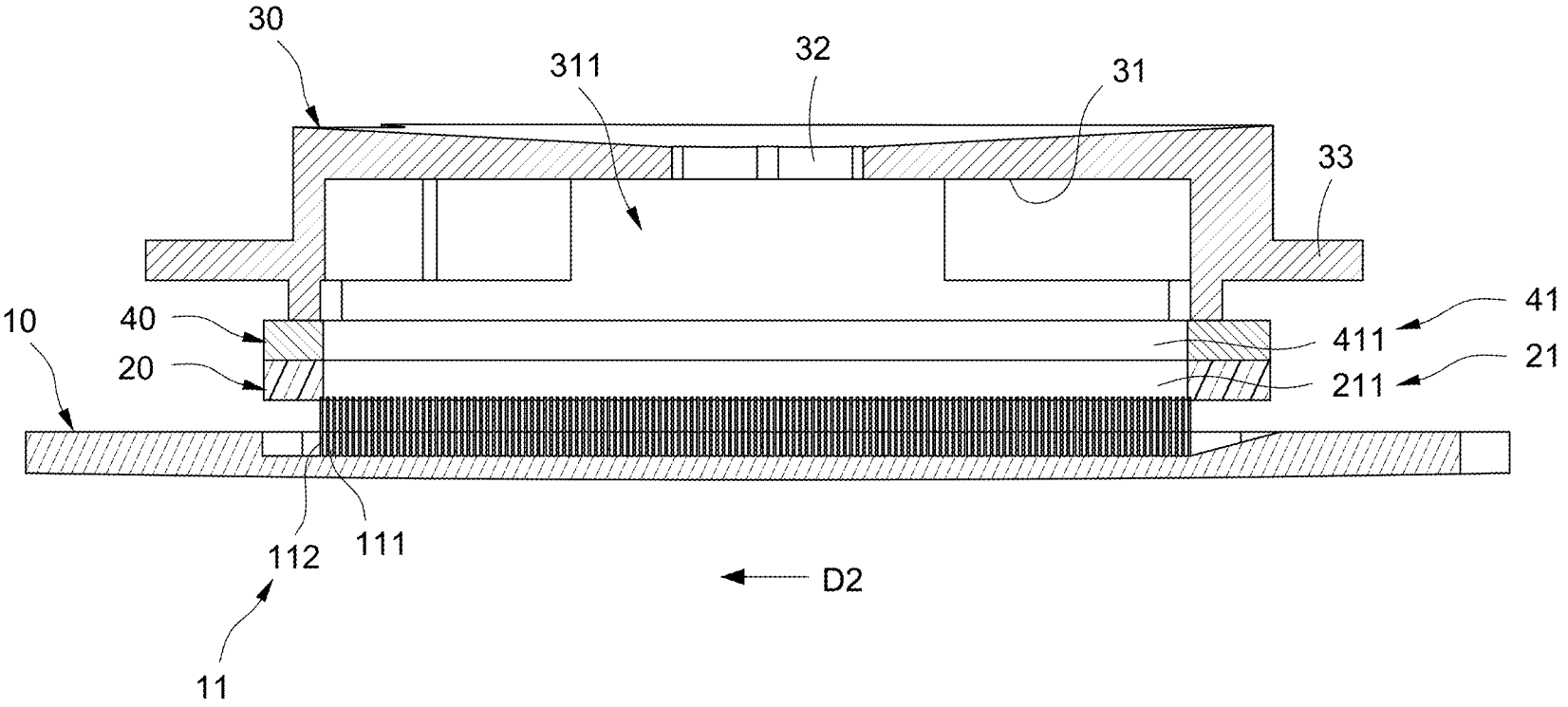
FIG. 2 is a partial cross-sectional side view of the present disclosure.
Figure 3:
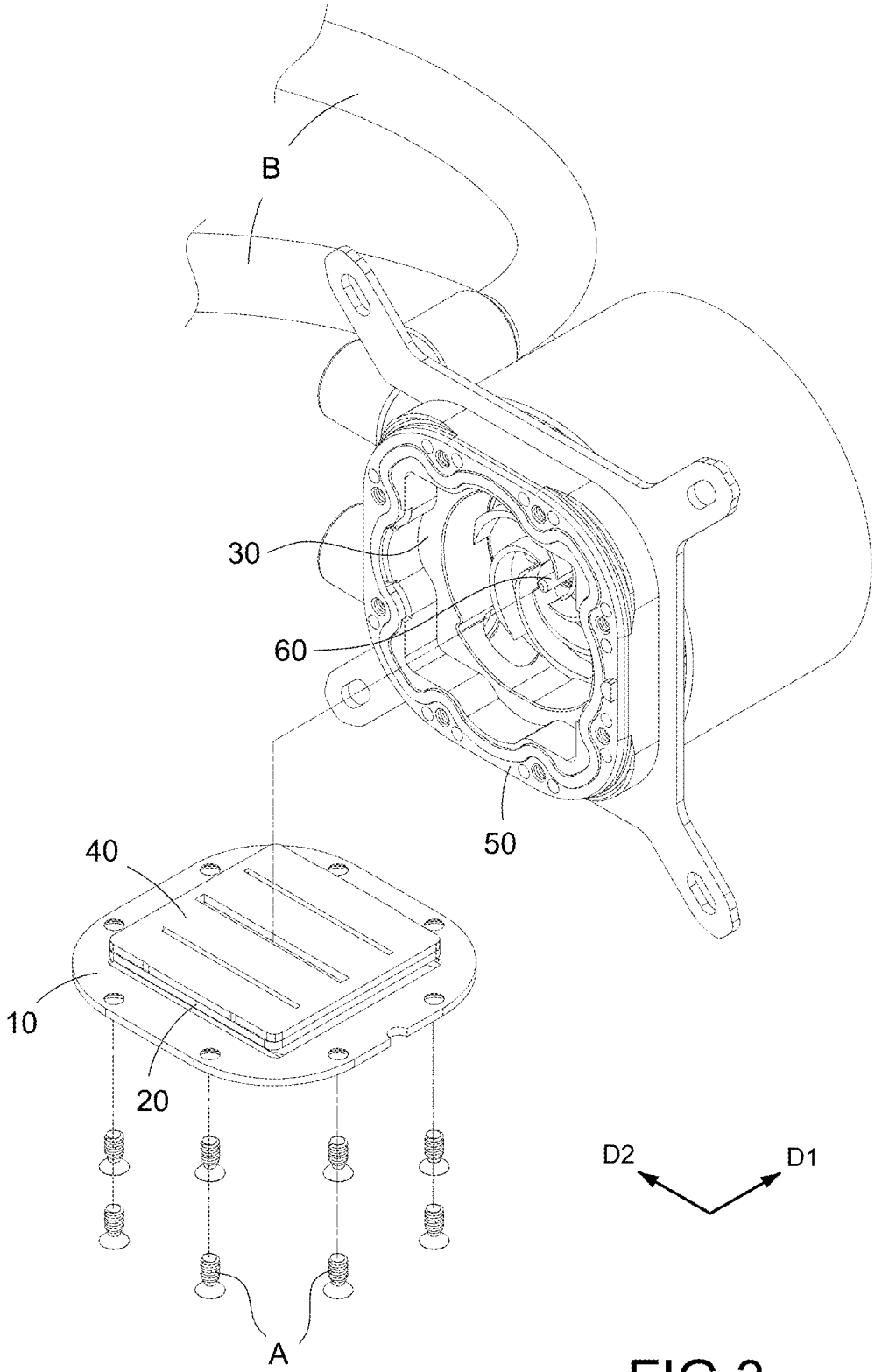
FIG. 3 is an exploded view of the present disclosure.
Figure 4:
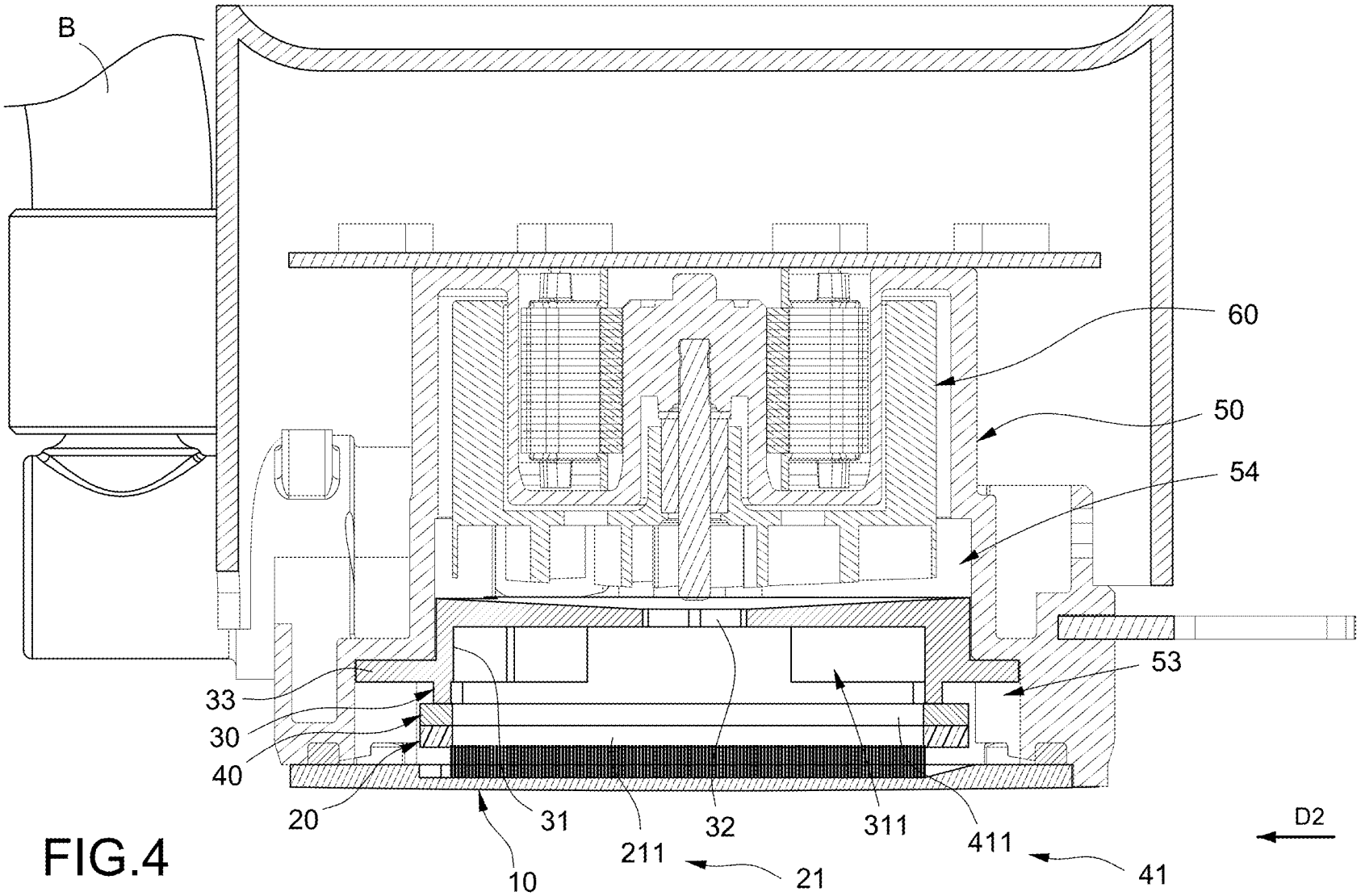
FIG. 4 is a cross-sectional side view of the present disclosure.
Figure 5:
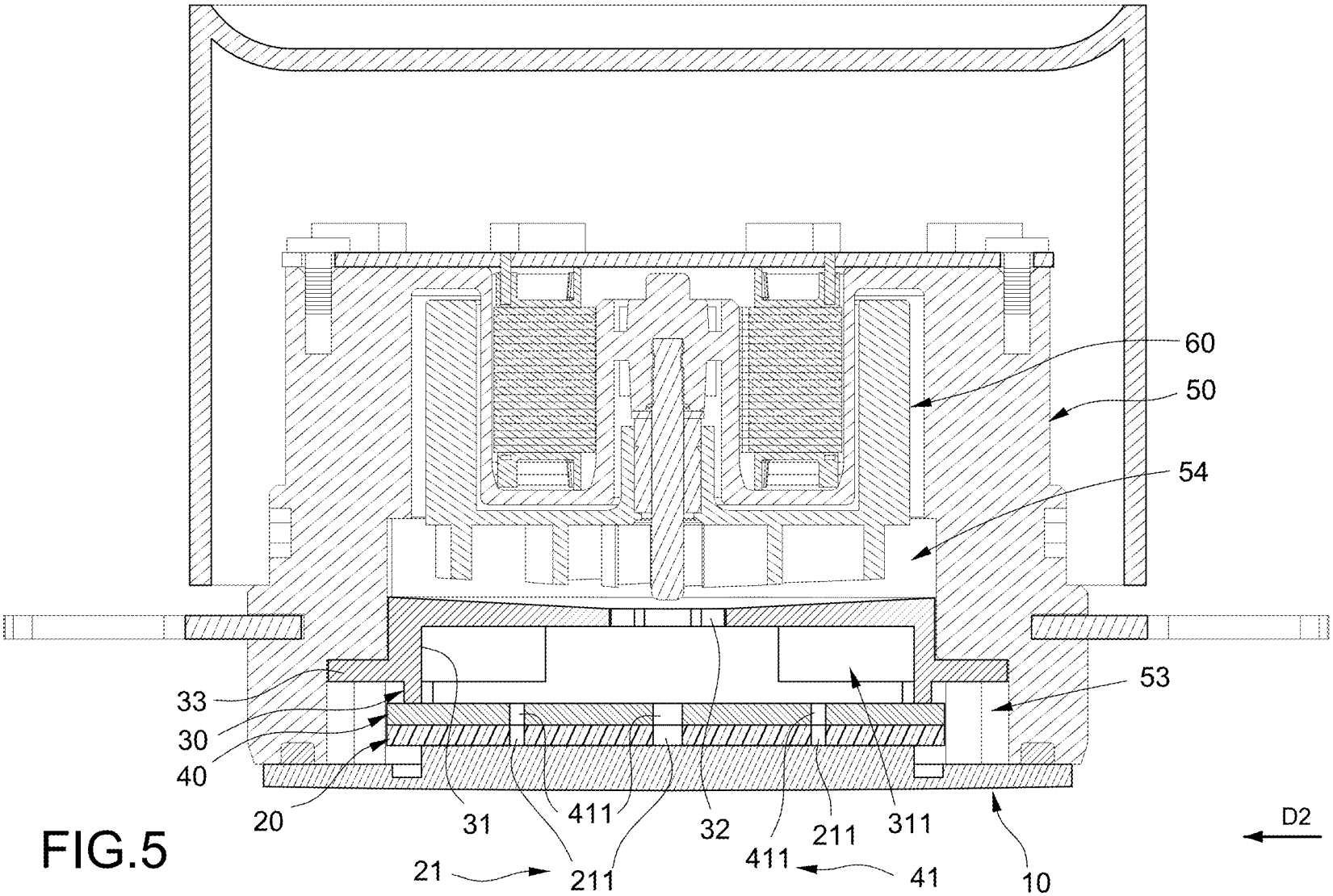
FIG. 5 is another cross-sectional side view of the present disclosure.
Figure 6:
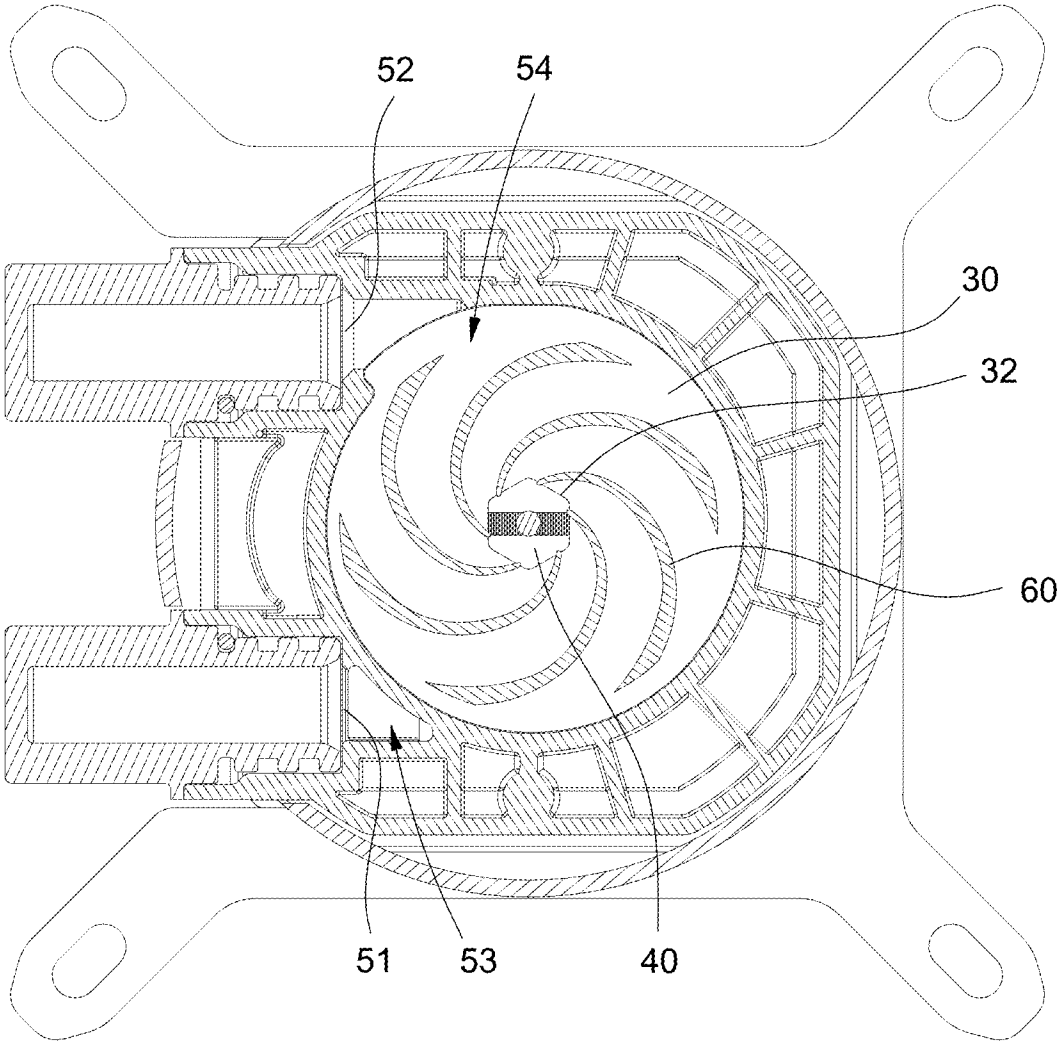
FIG. 6 is a cross-sectional top view of the present disclosure.

The present disclosure provides a liquid cooling heat dissipation device for a coolant flowing in one direction, the liquid cooling heat dissipation device is used to dissipate heat energy from a heat source (not shown in figures) attached to the bottom thereof. As shown in FIG. 1 and FIG. 2. The liquid cooling heat dissipation device of the present disclosure mainly includes a bottom seat 10, a baffle 20, and a cover 30.

In the embodiment, the bottom seat 10 is a metal plate, but the present disclosure is not limited to this embodiment. For example, the bottom seat 10 may also be a plate structure or block structure that is made of other materials with good thermal conductivity. The bottom seat 10 is used to attach on the heat source to absorb heat energy generated by the heat source. The bottom seat 10 has a plurality of heat dissipation members 11. A plurality of flow channels 111 is formed between the heat dissipation members 11. The flow channels 111 are for the coolant flowing therein to carry away heat energy captured by the heat dissipation members 11. In detail, each of the heat dissipation members 11 may be a sheet, column, plate, sphere or combination thereof extended upward a top of the bottom seat 10. In the embodiment, the plurality of heat dissipation members 11 includes a plurality of fins 112 arranged in parallel along a first direction D1, and each of the flow channels 111 is formed between two adjacent fins 112, that is each of the flow channels 111 in the embodiment is parallel to the first direction D1 and each of the fins 112. In addition, each of the fins 112 in the embodiment is integrally formed on the bottom seat 10 (or formed in one piece with the bottom seat 10) by skiving, but the present disclosure is not limited to this embodiment. For example, each of the fins 112 may also be arranged on the bottom seat 10 by welding, brazing, extruding, or molding.

The baffle 20 is arranged on the bottom seat 10. In detail, the baffle 20 attaches to each of the heat dissipation members 11 of the bottom seat 10. In the embodiment, the baffle 20 is made of silicone or rubber material to avoid crushing each of the heat dissipation members 11 of the bottom seat 10, but the present disclosure is not limited to this embodiment. The baffle 20 defines a plurality of slot groups 21 arranged in parallel along a second direction D2. Each of the slot groups 21 is communicated to the plurality of flow channels 111, and the first direction D1 intersects with the second direction D2 such that the coolant may flow into each of the slot groups 21 through each of the flow channels 111. In the embodiment, the first direction D1 is substantially perpendicular to the second direction D2, but the present disclosure is not limited to this embodiment, as long as the first direction D1 intersects with the second direction D2 and the first direction D1 is not parallel to the second direction D2. In addition, each of the slot groups 21 in the embodiment includes an elongated hole 211 extended along the second direction D2. Each of the elongated holes 211 is arranged in parallel along the second direction D2 and configured to cross each of the fins 112, but the present disclosure is not limited to this embodiment. For example, each of the slot groups 21 may also include a plurality of perforations arranged in a straight line or a rectangular matrix along the second direction D2.

The cover 30 is arranged above the baffle 20. The cover 30 defines a cavity 31 and a through hole 32. In detail, the cavity 31 is concave from a side of the cover 30 facing the baffle 20 such that the cover 30 is inverted U-shaped. The cover 30 covers each of the slot groups 21 of the baffle 20 such that the cavity 31 is communicated to each of the slot groups 21 to form a chamber 311. Two opposite sides of the chamber 311 are respectively communicated to the through hole 32 of the cover 30 and each of the slot groups 21 of the baffle 20. Therefore, the coolant may enter the chamber 311 for confluence from each of the flow channels 111 through each of the slot groups 21, and then exits the chamber 311 through the through hole 32 of the cover 30, so as to effectively increase a flow rate of the coolant through the through hole 32 from the chamber 311 to improve the heat dissipation efficiency of the liquid cooling heat dissipation device of the present disclosure.

Details are provided as follows. The liquid cooling heat dissipation device of the present disclosure further includes a pressed board 40. In the embodiment, the pressed board 40 is metal plate, but the present disclosure is not limited to this embodiment. The pressed board 40 is arranged between the baffle 20 and the cover 30. The cover 30 abuts against the pressed board 40 such that the pressed board 40 makes the baffle 20 to tightly abut against each of the heat dissipation members 11 of the bottom seat 10. The pressed board 40 defines a slit group 41. Each of the slot groups 21 is communicated to the chamber 311 through the slit group 41. In detail, the slit group 41 in the embodiment includes a plurality of transition channels 411 arranged in parallel along the second direction D2. A number of each of the transition channels 411 is equal to a number of each of the slot groups 21, and each of the transition channels 411 is corresponding to each of the slot groups 21, but the present disclosure is not limited to this embodiment. For example, the slit group 41 may also be a notch communicated to each of the slot groups 21, as long as each of the slot groups 21 may be communicated to the chamber 311 through the slit group 41.

Please refer to FIG. 3, FIG. 4, FIG. 5, and FIG. 0.6. The liquid cooling heat dissipation device of the present disclosure further includes a base seat 50. The base seat 50 is arranged on the bottom seat 10. In detail, the bottom seat 10 is fixed to the base seat 50 by a plurality of screws A passed through the bottom seat 10 and screwed to a bottom of the base seat 50, but the present disclosure is not limited to this embodiment. The base seat 50 defines an inlet 51 and an outlet 52. The inlet 51 and the outlet 52 are respectively connected to an infusion tube B to connect a liquid-cooling radiator (not shown in figures) such that the coolant may flow from the liquid cooling heat dissipation device to the liquid-cooling radiator to further dissipate heat energy and form a cycle loop. The base seat 50, the bottom seat 10, and the cover 30 together form an inlet chamber 53. The base seat 50 and the cover 30 together form an outlet chamber 54. The inlet 51 is communicated to each of the flow channels 111 through the inlet chamber 53. The through hole 32 is communicated to the outlet 52 through the outlet chamber 54. Therefore, after the coolant enters the inlet chamber 53 from the inlet 51, the coolant enters each of the flow channels 111 to sequentially pass through each of the slot groups 21 and the slit group 41, the coolant then enters the outlet chamber 54 through the through hole 32 after entering the chamber 311 for confluence, and the coolant finally exits the liquid cooling heat dissipation device from the outlet 52. In addition, the cover 30 has a convex edge 33. The convex edge 33 is protruded and extended from an outer wall of the cover 30. The base seat 50 abuts against the convex edge 33 such that the cover 30 makes the baffle 20 to tightly abut against the bottom seat 10.

In the embodiment, the liquid cooling heat dissipation device of the present disclosure further includes a pump 60, but the present disclosure is not limited to this embodiment. For example, the pump 60 may also be externally connected to an outside of the liquid cooling heat dissipation device, as long as the pump 60 may effectively push or pump the coolant. The pump 60 in the embodiment is arranged in the outlet chamber 54 to avoid affecting a heat absorption of the bottom seat 10 and a flow path of each of the flow channels 111. A suction force is generated when the pump 60 operates, the coolant smoothly and sequentially enters the inlet chamber 53, each of the flow channels 111, each of the slot groups 21, the slit group 41, the chamber 311, the through hole 32, and the outlet chamber 54 from the inlet 51 by the suction force and exits the liquid cooling heat dissipation device through the outlet 52 to flow to the liquid-cooling radiator for loop.

In the liquid cooling heat dissipation device of the present disclosure, through the cavity 31 of the cover 30 covering each of the slot groups 21, the coolant may be converged in the chamber 311 formed by the cavity 31 and the baffle 20, so as to effectively increase the flow rate of the coolant through the through hole 32 from the chamber 311 to improve the heat dissipation efficiency of the liquid cooling heat dissipation device.

It shall be understood that the present disclosure may have other types of embodiments, and a person with ordinary skills in the art of the technical field of the present disclosure may make various changes and modifications corresponding to the present disclosure without deviating the principle and substance of the present disclosure; however, such corresponding changes and modification shall be considered to be within the claimed scope of the present disclosure.

What is claimed is:

1. A liquid cooling heat dissipation device for a coolant flowing in one direction comprising:

a bottom seat, comprising a plurality of heat dissipation members, a plurality of flow channels formed between the heat dissipation members;

a baffle plate, arranged on the bottom seat, the baffle plate defining a plurality of slot groups arranged in parallel, each of the slot groups in fluid communication with each of the plurality of flow channels;

a press plate, arranged on the baffle plate, the press plate defining a plurality of slot groups matching the plurality of slot groups of the baffle plate;

a cover, arranged on the press plate covering each of the slot groups, the cover defining a cavity and a through hole, the cavity being concave from a side of the cover facing the press plate and in fluid communication with each of the slot groups to form a chamber between the cover and the press plate, two opposite sides of the chamber respectively communicated to the through hole and each of the slot groups;

a base seat configured to press against the cover thereby causing the press plate to press the baffle plate against the heat dissipation members, the base seat and the cover defining an outlet chamber therebetween; and a pump having an impellor located in the outlet chamber;

wherein an inlet chamber is formed between the cover and the bottom seat, the inlet chamber in fluid communication with each of the plurality of flow channels; and wherein the device is configured such that a suction force may be generated by the pump to pull fluid sequentially from the inlet chamber, the plurality of flow channels, the slot groups, the chamber, the through hole, and then into the outlet chamber.

2. The liquid cooling heat dissipation device according to claim 1, wherein the plurality of heat dissipation members comprises a plurality of fins arranged in parallel along a first direction, each of the flow channels is formed between two adjacent fins.

3. The liquid cooling heat dissipation device according to claim 2, wherein each of the slot groups is arranged in parallel along a second direction, the first direction intersects with the second direction.

4. The liquid cooling heat dissipation device according to claim 2, wherein each of the slot groups comprises an elongated hole extended along a second direction, each of the elongated holes is arranged in parallel along the second direction and configured to cross each of the fins.

5. The liquid cooling heat dissipation device according to claim 3, wherein the first direction is perpendicular to the second direction.

6. The liquid cooling heat dissipation device according to claim 4, wherein the first direction is perpendicular to the second direction.

7. The liquid coaling heat dissipation device according to claim 1, wherein the base seat, the bottom seat, and the cover form the inlet chamber.

8. The liquid cooling heat dissipation device according to claim 1, wherein the cover comprises a convex edge, the base seat abuts against the convex edge thereby causing the base seat to press against the press plate.

9. The liquid cooling heat dissipation device according to claim 1, wherein the pump is configured in the outlet chamber such that the pump pushes fluid out of the outlet chamber through an outlet.

* * * * *